US010583543B1

(12) United States Patent
Tiskevics et al.

(10) Patent No.: US 10,583,543 B1
(45) Date of Patent: Mar. 10, 2020

(54) PORTABLE HYDRAULIC PUMP FOR USE WITH TORQUE WRENCH

(71) Applicants: Donald Tiskevics, Otley, IA (US); Brent Hendricks, Grinnell, IA (US)

(72) Inventors: Donald Tiskevics, Otley, IA (US); Brent Hendricks, Grinnell, IA (US)

(73) Assignee: VP Sales and Manufacturing LP, Alice, TX (US)

( * ) Notice: Subject to any disclaimer, the term of this patent is extended or adjusted under 35 U.S.C. 154(b) by 0 days.

(21) Appl. No.: 16/359,112

(22) Filed: Mar. 20, 2019

(51) Int. Cl.
*B25B 21/00* (2006.01)
*B25B 23/145* (2006.01)

(52) U.S. Cl.
CPC ..... *B25B 21/005* (2013.01); *B25B 23/1453* (2013.01); *B25B 23/1456* (2013.01)

(58) Field of Classification Search
CPC ... B25B 23/1453; B25B 21/005; B25B 19/00; F15B 1/265; F15B 2211/615
See application file for complete search history.

(56) References Cited

FOREIGN PATENT DOCUMENTS

| | | | | |
|---|---|---|---|---|
| CN | 202954935 | | 5/2013 | |
| CN | 205876854 | * | 1/2017 | ..... F15B 15/18 |

OTHER PUBLICATIONS

Machine Translation of CN205876854.*

* cited by examiner

*Primary Examiner* — Michael Leslie
*Assistant Examiner* — Daniel S Collins
(74) *Attorney, Agent, or Firm* — M. Susan Spiering; Ferrells PLLC

(57) ABSTRACT

Disclosed herein is an improved hydraulic torque wrench pump (HTWP) which utilizes a combined filtration system and cooling system for filtering and cooling substantially all the oil returned to the pump including from a hydraulic torque wrench. The hydraulic torque wrench pump includes an electric motor and one or more pumping elements arranged in a protective frame. The electric motor used in association with the hydraulic pump has a high-efficiency design that includes a high power to height ratio and yields efficiency in a range of 90% to 95%. A sealed oil tank is used for storing the oil. The sealed oil tank helps in restricting one or more impurities from entering and contaminating the oil.

7 Claims, 9 Drawing Sheets

PORTABLE HYDRAULIC PUMP FOR USE WITH TORQUE WRENCH

FIELD OF THE INVENTION

The present invention relates to a hydraulic torque wrench pump (HTWP). More particularly, the present invention relates to a filtration and cooling system for oil used in a hydraulic pump that is used with a hydraulic torque wrench.

DESCRIPTION OF THE RELATED ART

A hydraulic torque wrench is used to exert torque on a fastener to achieve required tightening and loosening thereof. The torque wrench uses hydraulics for exerting the torque. The fastener is a hardware device used for mechanically securing two or more hardware components together. The hydraulic torque wrench is applied to a fastener, such as a nut directly or in conjunction with an impact socket.

A hydraulic torque wrench pump (HTWP) (herein after referred to as hydraulic pump) is typically used for pumping oil from a reservoir and delivering it to the hydraulic torque wrench. In operation, the hydraulic pump performs two functions. First, mechanical action of the hydraulic pump creates vacuum at an inlet of a pumping element of the hydraulic pump and the vacuum allows atmospheric pressure to force the oil from the reservoir into the inlet of the pumping element of the hydraulic pump. Second, mechanical action of the hydraulic pump delivers the oil to an outlet of the hydraulic pump, pressurizes it, and forces it to the hydraulic torque wrench. The hydraulic pump provides necessary flow for developing pressure in the hydraulic torque wrench. The hydraulic torque wrench uses the pressure to provide torque to the fastener. Providing torque to the fastener ultimately tightens or loosens the nut.

During the tightening and loosening process, temperature of the oil increases. Some of the conventional hydraulic pumps provide cooling systems for cooling the oil. In a conventional cooling system on a pneumatic hydraulic pump, the oil either gets super-cooled or gets frozen which causes a buildup of water in the oil. Generally, a metal exhaust line is run from the exhaust port on an air motor through the oil the tank and then through a muffler. The temperature of the metal exhaust line often falls below freezing and creates a condensation point at the air space between the top of the tank and the top of the oil level. The condensation thus created enters the oil which causes premature oil failure and potential damage to the pump. In a conventional cooling system on an electric hydraulic pump, it is difficult to regulate temperature of the oil and the oil frequently overheats. In either case, the water in the oil or the high oil temperature lessens the life and performance of the hydraulic pump. In some cases, the water or high oil temperature might cause the hydraulic pump to fail. The hydraulic pumps work in different environmental conditions. The conventional hydraulic pumps do not come with a sealed oil tank which makes impurities, such as dirt, water, or other contaminants, easier to get into the oil tank and contaminate the oil. The impurities wear down O-rings and the honed finishes of the hydraulic pump components. The O-rings are used at an interface of two or more connecting parts to make it leak proof. The honed finishes are used for making the components efficient and "leak free". The wear and tear of the O-rings and the components that are honed ultimately lead to failure of the hydraulic pump or reduction in performance of the hydraulic pump.

Chinese patent document 202,954,935 discloses a special electro hydraulic pump for multilevel flow hydraulic pressure wrench. The hydraulic pump includes a fuel tank, a pump body, a motor, a set of valves, and a protective frame. The hydraulic pump further includes a cooler. The pump body further includes a filter screen. Before entering into the fuel tank, the oil passes through the cooler. The impurities in the oil may result in failure of the hydraulic pump.

Chinese patent document 205,876,854 discloses a fully-automatic hydraulic wrench pump station. The pump station includes an axial piston, a tank, an automatic switching valve, a filter, a pressure gauge, an air cleaner, and a hydraulic wrench. The oil is filtered before entering the tank. Increased temperature of the oil might result in reduced life and performance of the oil and may result in failure of the hydraulic pump.

In light of the foregoing, there exists a need for a filtration and cooling system that prevents wear and tear of the O-rings and honed components and enhances life and performance of the HTWP.

SUMMARY

Disclosed herein is an improved hydraulic torque wrench pump (HTWP) which uses a filtration system and a cooling system for filtering and cooling the oil that is returned from a hydraulic wrench. The hydraulic pump includes a pneumatic motor or an electric motor and one or more pumping elements arranged in a protective frame. A hydraulic wrench is associated with the hydraulic pump by way of at least one twin-line hose. At least one sealed oil tank is arranged in the protective frame. The sealed oil tank is in fluidic communication with a first passage for receiving the returned oil and a second passage that is in communication with a suction port of the pumping element of the hydraulic pump for delivering oil to the hydraulic wrench. The filtration system and the cooling system are arranged in a tandem fashion and accommodated within the first passage. The filtration system filters the oil returned from the hydraulic torque wrench and temperature of the filtered oil is further maintained or regulated by using the cooling system.

The filtration system helps in filtering the oil returned from the hydraulic torque wrench. The cooling system helps in controlling temperature of the filtered oil. The filtration of the returned oil helps in preventing wear and tear of the O-ring and other honed components of the hydraulic pump, thereby leading to improved life of the hydraulic pump. The seals of the hydraulic torque wrench often break if the pump fails to cool the oil adequately. Cooling of the returned oil helps in preventing breakdown of the returned oil which leads to improved life of the oil. Maintaining the returned oil at a sufficiently low temperature prevents violation of the seals associated with the hydraulic pump. The oil disposal costs are reduced due to improved life of the oil. The filtration and cooling systems filter and cool substantially all the oil pumped by the pumping elements of the hydraulic pump. In the present invention, the returned oil passes through both the filtration and cooling systems before it enters the sealed oil tank. This helps the hydraulic pump to keep the sealed oil tank clean even after oil passes through dirty hoses and fittings.

BRIEF DESCRIPTION OF THE DRAWINGS

The accompanying drawings illustrate the various embodiments of systems, methods, and other aspects of the invention. It will be apparent to a person skilled in the art that the illustrated element boundaries in the figures represent one example of the boundaries. In some examples, one element may be designed as multiple elements, or multiple elements may be designed as one element. In some examples, an element shown as an internal component of one element may be implemented as an external component in another, and vice versa.

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

Further areas of applicability of the present invention will become apparent from the detailed description provided hereinafter. It should be understood that the detailed description of exemplary embodiments is intended for illustration purposes only and is, therefore, not intended to necessarily limit the scope of the present invention.

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise.

Unless otherwise noted, pressures discussed herein are reported as gauge values; i.e., psig or barg.

Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention.

There may be additional components described within the application that are not depicted on one of the described drawings. In the event, such a component is described, but not depicted in a drawing, the absence of such a drawing should not be considered as an omission of such design from the specification.

Before describing the present invention in detail, it should be observed that the present invention utilizes a combination of system components which constitutes a filtration and cooling system for a hydraulic torque wrench pump (HTWP). Accordingly, the components and the method steps have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1A:
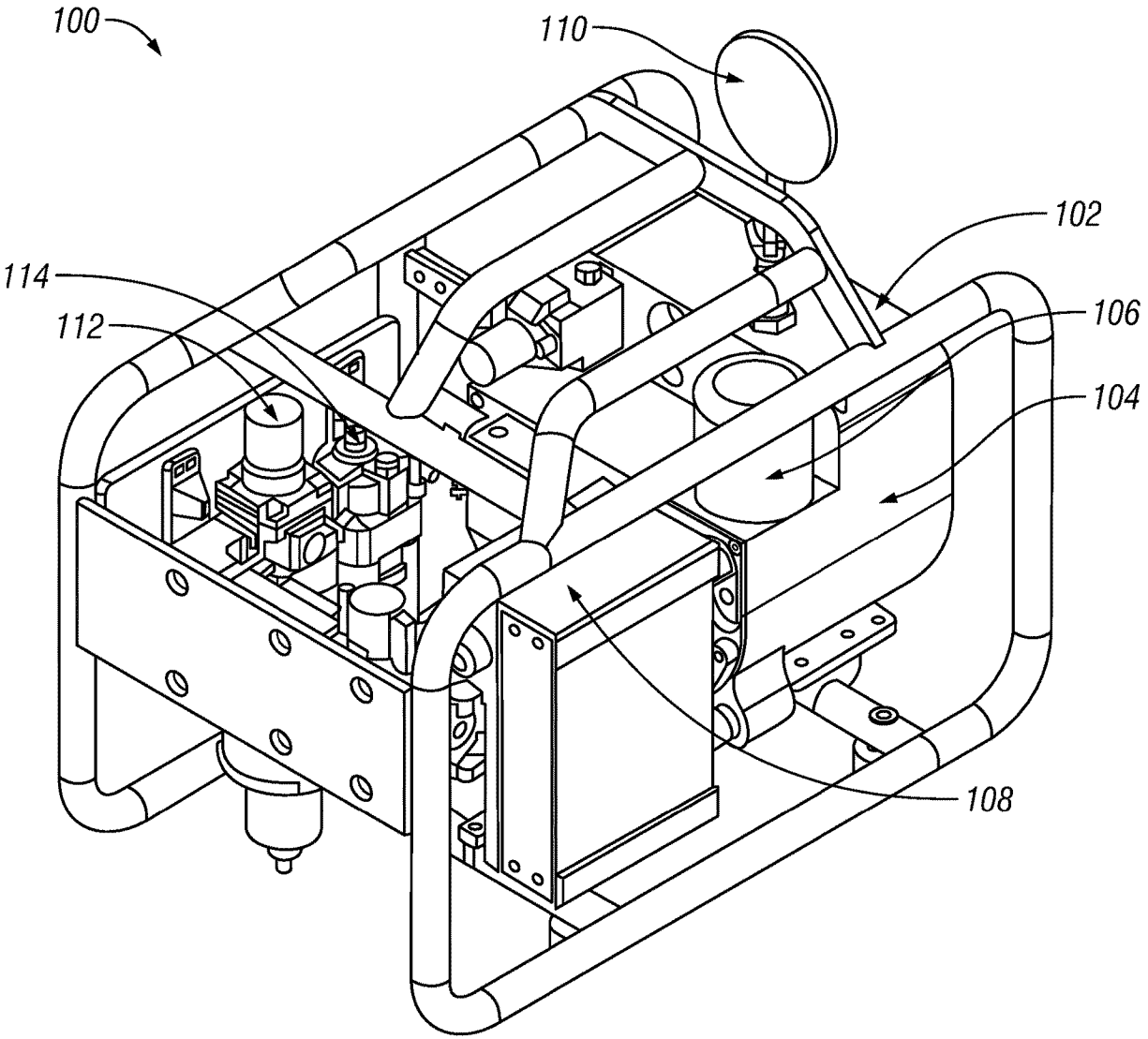
FIG. 1A shows a perspective view of a hydraulic pump.

The present invention provides a filtration and cooling system for a hydraulic pump that enhances the life of the hydraulic pump. FIG. 1A shows a perspective view of a hydraulic pump 100, in accordance with an embodiment of the present invention. The hydraulic pump 100 includes a pneumatic manifold 102, a sealed oil tank 104, a filter 106, a cooler 108, and a pressure gauge 110. In alternative embodiments, an electric manifold is used, as discussed with respect to FIG. 3A-3C below. The pneumatic manifold 102 receives the oil which is either directed to the advance action of the tool or to the retract action of the tool. A gauge 110 is located on pneumatic manifold 102 as well as the manual relief valve that sets the pressure. The pneumatic manifold also contains couplers that connect the torque wrench to the pump. When the oil is being removed from the tool, it passes through pneumatic manifold 102 before going through filtration at filter 106 and cooling at cooler 108. Filter/regulator 112 filters the air to the system and maintains a set pressure for operation and lubricator 114 prevents the motor from seizing up due to corrosion and keeps it running efficiently. Together, filter/regulator 112 and lubricator 114 serve to protect the air motor that drives the pumping elements The hydraulic pump 100 is a hydraulic torque wrench pump (HTWP). The hydraulic torque wrench pump (HTWP) is used to operate a hydraulic torque wrench (not shown). The hydraulic torque wrench is associated with the hydraulic pump 100 by way of at least one twin-line hose. In an embodiment, the hydraulic pump 100 is a double acting cylinder pump. The words "hydraulic pump" and "hydraulic torque wrench pump (HTWP)" are interchangeably used throughout.

The pneumatic manifold 102 is used for pumping oil from the sealed oil tank 104 with the help of first through fourth pumping elements 202 comprising 202*a*, 202*b*, 202*c*, 202*d* (shown in FIG. 2A) associated with the pneumatic manifold 102 for generating the required pressure. The oil pumped from the sealed oil tank 104 is passed to the hydraulic torque wrench (not shown) with the required pressure. The pressure is used by the hydraulic torque wrench to tighten or loosen a fastener, such as a nut. After going through the tightening or loosening operation, the oil is returned to the hydraulic pump 100. The returned oil is passed through pneumatic manifold 102 to the filter 106 to filter out one or more impurities, such as dirt, water, or other contaminants, contained therein. The filtered oil is further passed to the cooler 108 to maintain temperature of the returned oil at a desired level. In one embodiment, the desired temperature level for the returned oil may be below 160° F. The sealed oil tank 104 is used for storing the returned oil from the cooler 108. The sealed oil tank 104 helps in restricting the one or more impurities from entering and contaminating the oil. The sealed oil tank 104 is slightly pressurized which helps in improving efficiency of the hydraulic pump 100 by forcing the oil into the pumping elements as well as by reducing the amount of ambient air being drawn into the sealed oil tank 104. The pressure gauge 110 is used for measuring pressure of the pumped oil.

Figure 1B:
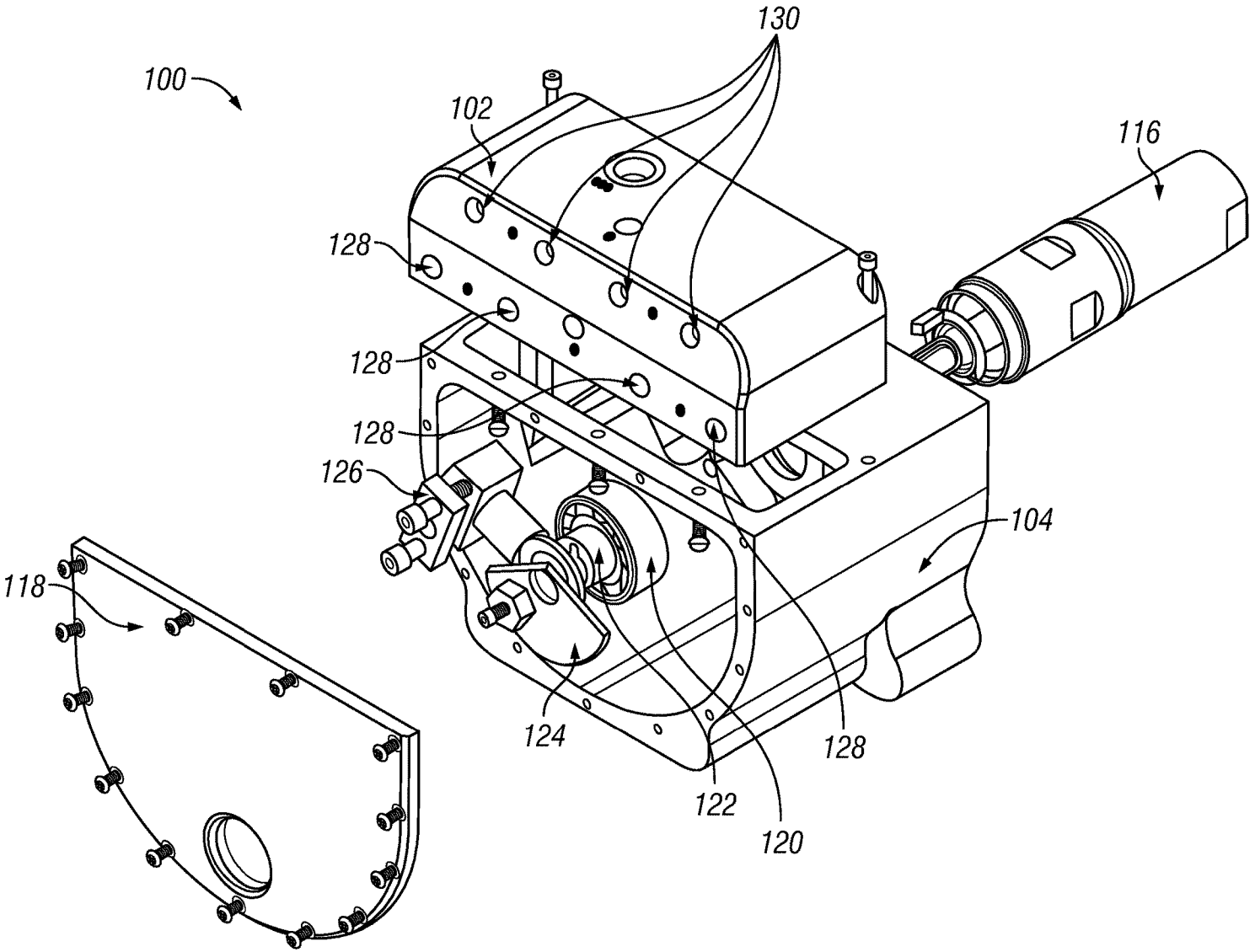
FIG. 1B shows an exploded view of the hydraulic pump of FIG. 1A.

FIG. 1B shows an exploded view of the hydraulic pump 100, in accordance with an embodiment of the present invention. The hydraulic pump 100 further includes an air motor 116, a front cover plate 118, a bearing 120, a motor shaft 122, a counter balance 124, a pump element port 126, a terminal A 128, and a terminal B 130.

The air motor 116 functions to convert compressed air energy to mechanical work by rotating the motor shaft 122. The bearing 120 functions to reduce friction between the rotating shaft and the fixed elements of the hydraulic pump 100. The air motor 116 creates mechanical movement in the motor shaft 122 which is connected to the counter balance 124. The counter balance 124 helps in returning the pump 100 to its initial position. The movement in the motor shaft 122 helps the first through fourth pumping elements 202*a*, 202*b*, 202*c*, 202*d* (shown in FIG. 2A) pull the oil from the sealed oil tank 104. The front cover plate 118 is used for covering the sealed oil tank 104. The terminal A 128 functions to provide the pumped oil to the hydraulic torque wrench. The terminal B 130 is used for receiving the oil returned from the hydraulic torque wrench.

Figure 2A:
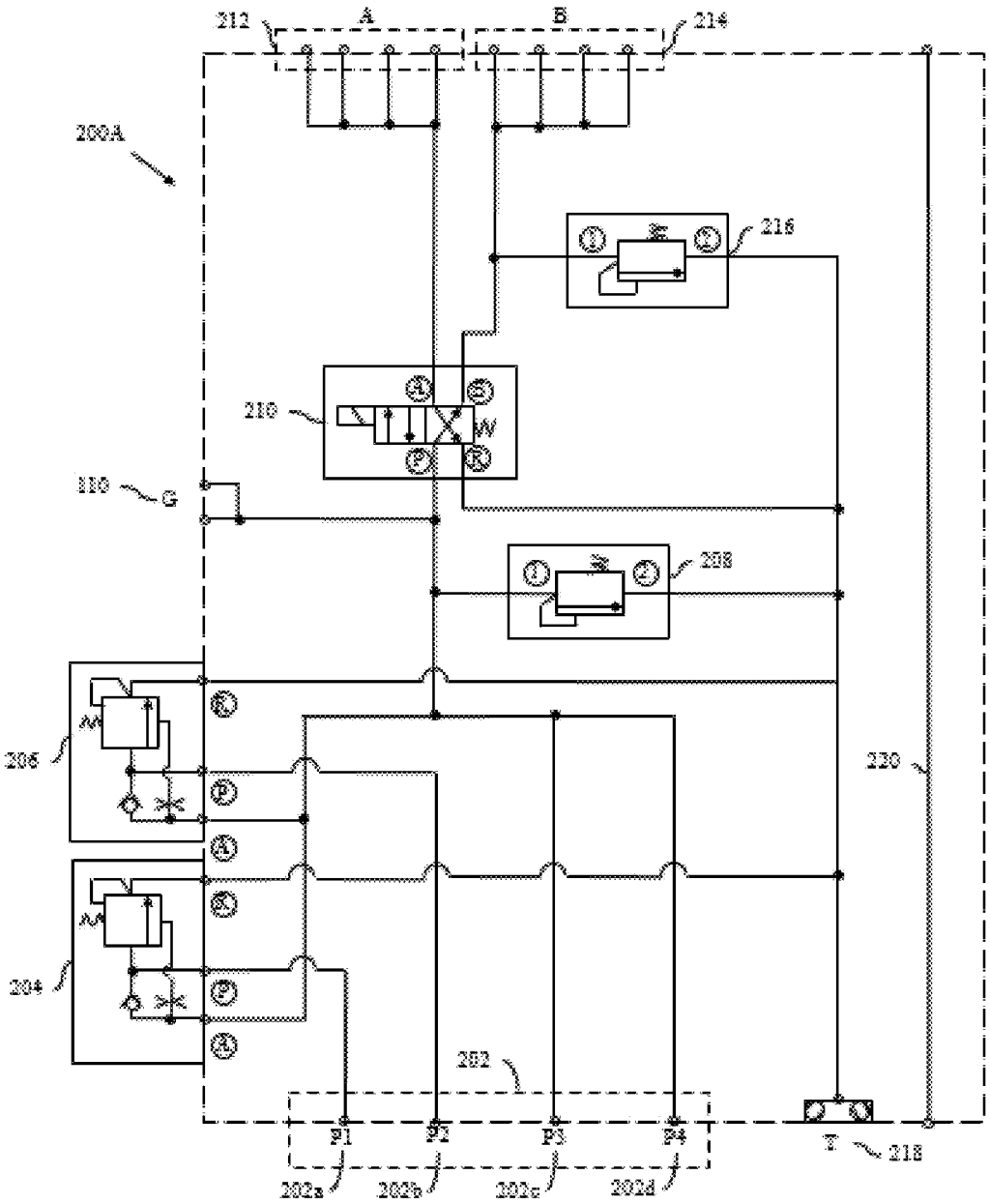
FIG. 2A shows a hydraulic schematic for a pneumatic manifold affixed to the hydraulic pump of FIG. 1A.

FIG. 2A shows a hydraulic schematic 200A of the pneumatic manifold 102, in accordance with an embodiment of the present invention. The pneumatic manifold 102 includes the first through fourth pumping elements P1-P4, 202*a*-202*d*, respectively used for pumping oil from the sealed oil tank 104, two unloading valves 204 and 206, a four-way two positional directional valve 210, a terminal A 212, a terminal B 214, two pressure relief valves 208 and 216, a T hole 218, a breather 220, the pressure gauge 110, and a pneumatic motor (not shown).

In an embodiment, the first through fourth pumping elements P1-P4, 202*a*-202*d*, are used for pumping the oil from the sealed oil tank 104, and help to generate the required pressure. Each pumping element progressively has a lower oil flow rate delivering higher pressure, and therefore horsepower/torque, to the tool. The first pumping element P1 202*a* operates at about 2.2 liters per minute (LPM) to generate up to about 1,500 psi pressure in association with the unloading valve 204. The second pumping element P2 202*b* operates at about 0.5 LPM to generate up to 5,000 psi pressure in association with the unloading valve 206. The third pumping element P3 202*c* and the fourth pumping element P4 202*d* operate at about 0.3 LPM each to generate up to about 10,000 psi pressure. Those of skill in the art will recognize that the pumping elements described can be modified in size to generate more (or less) pressure as may be needed by the user of the tool In an embodiment, the first pumping element P1 202*a* functions or operates in association with the unloading valve 204 to generate 1,500 psi pressure. The unloading valve 204 receives the oil from the first pumping element P1 202*a* by way of a port P associated with the unloading valve 204. If the pressure of the oil is below or equal to 1,500 psi, the oil is passed to unloading valve 204 and subsequently to the four-way two positional directional valve 210. If pressure is above 1,500 psi, the oil is passed to unloading valve 204 which shifts, passing oil subsequently to the T hole 218, and then to the tank after filtration and cooling, by way of a port R (R indicates return to tank) until a pressure of 1,500 psi is reestablished. The four-way two positional directional valve 210 further passes the oil to the terminal A 212 or the terminal B 214. The pressure gauge 110 is used for measuring the pressure of the oil.

The second pumping element P2 202*b* operates in association with the unloading valve 206 to generate up to about 5,000 psi pressure. The unloading valve 206 receives the oil from the second pumping element P2 202*b* via port P associated with the unloading valve 206. Once the pressure reaches 5,000 psi, oil may be passed to the pressure relief valve 208. If the pressure of the oil is above 5,000 psi, the oil is passed to the tank via T hole 218 directly from unloading valve 206 or from pressure relief valve 208 for maintaining about 5,000 psi pressure. If the pressure of the oil is below or equal to about 5,000 psi, the oil is passed to the four-way two positional directional valve 210. If the pressure is above about 5,000 psi, the oil is passed to the tank via T hole 218 by way of a port R (R indicates return to tank). The four-way two positional directional valve 210 further passes the oil to the terminal A 212 or the terminal B 214. The pressure gauge 110 is used for measuring the pressure of the oil.

The terminal A 212 or the terminal B 214 receives the oil returned from the hydraulic torque wrench (not shown). The returned oil from Terminal B is passed to the tank via T hole 218, if the pressure of the returned oil is above or equal to a predetermined pressure value, by way of the pressure relief valve 216. If oil is returned from Terminal A and the pressure meets or exceeds the maximum value, returned oil is released to T hole 218 by way of directional valve 210. If the pressure of the returned oil is below the predetermined pressure value, the returned oil is passed to the tank via T hole 218 by way of the four-way two positional directional valve 210. The breather 220 is used for keeping ambient air out of the hydraulic pump 100.

Oil pumped from the third and fourth pumping elements P3 202*c* and P4 202*d* is delivered to Terminal A 212 or Terminal B 214 by way of directional valve 210, or to T hole 218 by way of directional valve 210 or by way of pressure relief valve 208 or 216 if the maximum pressure is met or exceeded.

Figure 2B:
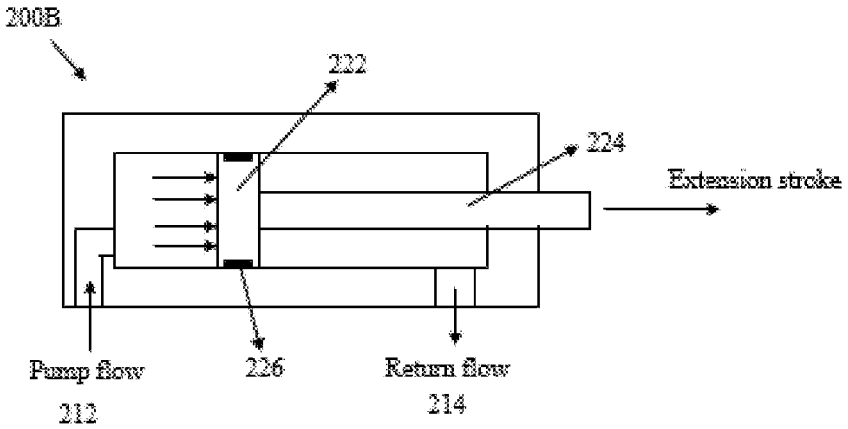
FIGS. 2B-2C show a schematic for a double acting cylinder connected to the hydraulic pump of FIG. 1A affixed with the pneumatic manifold of FIG. 2A.

FIG. 2B shows a schematic 200B for a double acting cylinder in an extension stroke, in accordance with an embodiment of the present invention. The double acting cylinder is connected to the hydraulic pump 100 via a twin-line hose. In an embodiment, the hydraulic pump 100 may be connected to the hydraulic torque wrench which functions as a double acting cylinder. In another embodiment, the double acting cylinder may be a part of the hydraulic torque wrench, such as a powerhead. The double acting cylinder includes a piston 222, a rod 224, and a piston seal 226. In the extension stroke, the oil passes to the double acting cylinder by way of the terminal A 212 and piston 222 shifts to extend rod 224 in the double acting cylinder outward (i.e., to the right in FIG. 2B). The oil is returned to the hydraulic pump 100 by way of the terminal B 214 from the double acting cylinder. The piston seal 226 is used for preventing leakage in the double acting cylinder. When the piston is fully extended, no more oil can move from terminal A 212 to terminal B 214. In this static position, all oil being pumped by pumping elements 202 *a,b,c,d*, goes to pressure relief valve 208 and returns to tank 104 via T hole 218 after filtration and cooling, as discussed below with respect to FIG. 4.

Figure 2C:
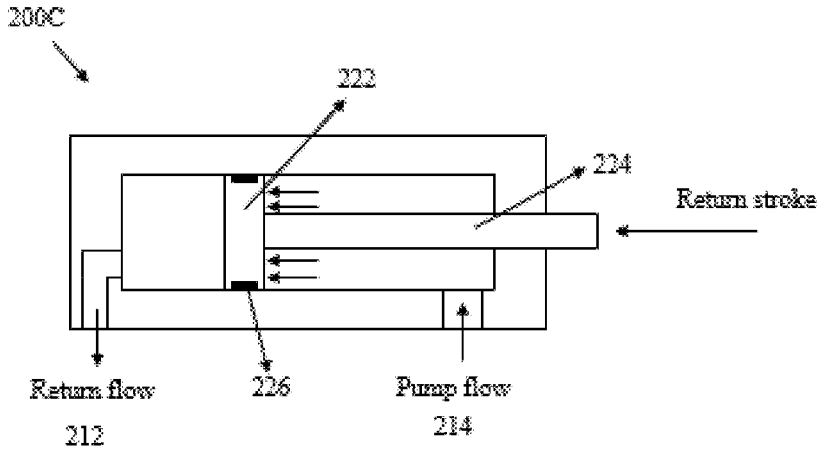
Figure 3A:
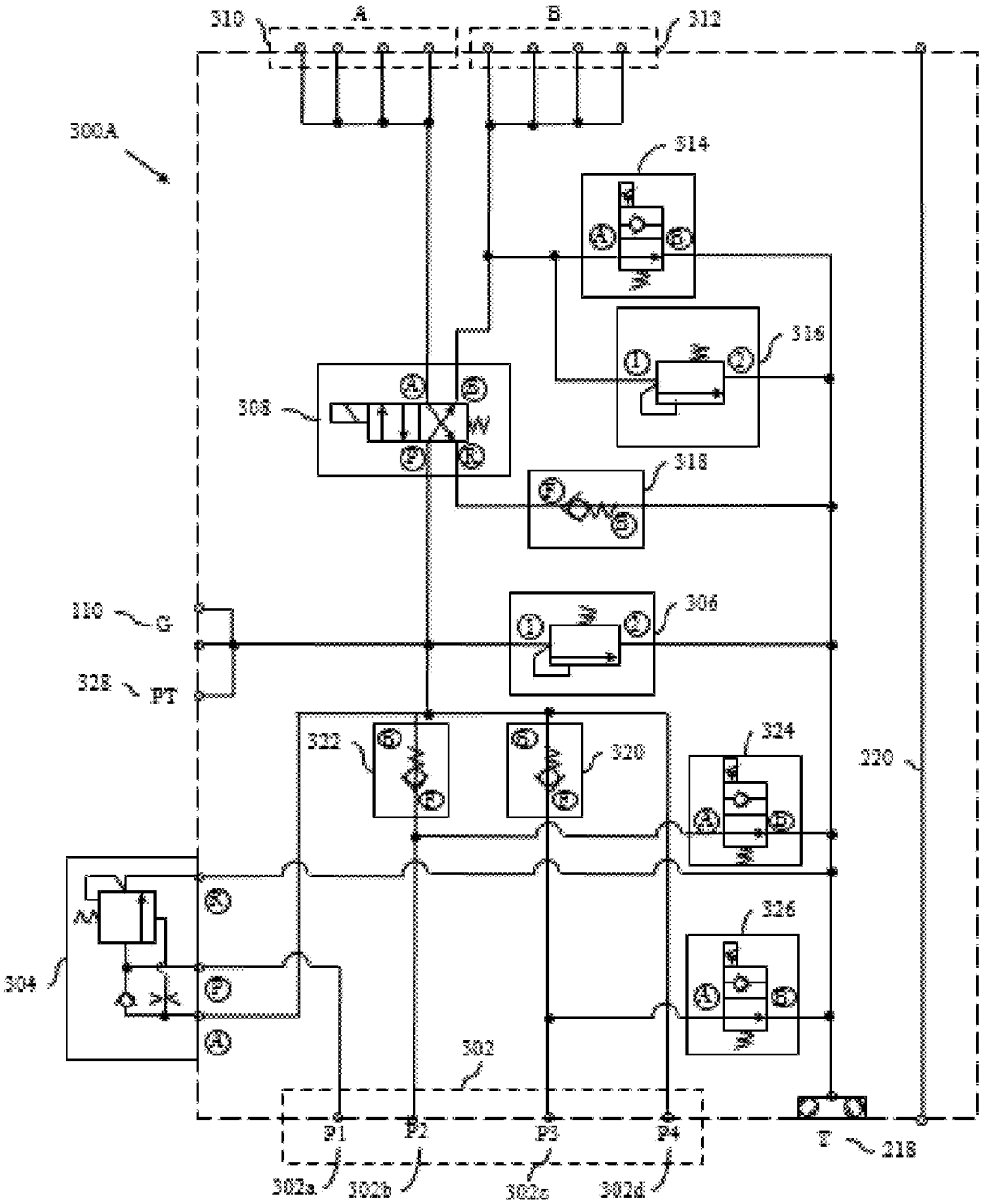
FIG. 3A shows a hydraulic schematic for an electric manifold affixed to the hydraulic pump of FIG. 1A.

FIG. 2C shows a schematic 200C for the double acting cylinder in a return stroke, in accordance with an embodiment of the present invention. In the return stroke, the oil passes to the double acting cylinder by way of the terminal B 214 and piston 222 shifts to retract rod 224 into the double acting cylinder (i.e., to the left in FIG. 2C). The oil is returned to the hydraulic pump 100 by way of the terminal A 212 from the double acting cylinder. As with the extension stroke, once the piston is fully retracted, all oil from pumping elements 202 *a,b,c,d* goes to pressure relief valve 208 and returns to tank 104, via T hole 218, after filtration and cooling FIG. 3A shows hydraulic schematic 300A of the electric manifold (similar to and an alternative for the pneumatic manifold 102), in accordance with an alternative embodiment of the present invention. The hydraulic schematic 300A includes first through fourth pumping elements P1-P4, 302 comprising 302*a*-302*d*, respectively used for pumping oil from the sealed oil tank 104, an unloading valve 304, two pressure relief valves 306 and 316, a four-way two positional directional valve 308, a terminal A 310, a terminal B 312, three directional seated valves 314, 324, and 326, three check valves 318, 320, and 322, the T hole 218, the breather 220, a pressure transducer 328, and an electric motor (not shown).

In this embodiment, the first pumping element P1 302*a* works in association with the unloading valve 304 to generate the required pressure. The unloading valve 304 receives the oil from the first pumping element P1 302*a* by way of a port P associated with the unloading valve 304. As the oil meets or exceeds the maximum pressure, the oil leaving check valve 322 is passed to the pressure relief valve 306 and then to the tank via T hole 218 for maintaining the pressure of the oil. If the pressure of the oil is below or equal to the maximum pressure, the oil is passed to the four-way two positional directional valve 308. The four-way two positional directional valve 308 further passes the oil to either the terminal A 310 or the terminal B 312, depending upon the stroke. The pressure gauge 110 is used for measuring the pressure of the oil. The pressure transducer 328 reads the pressure at the first through third directional seated valves 314, 324, and 326 and control of the first through third directional seated valves 314, 324, and 326 shifts accordingly.

The second pumping element P2 302*b* works in association with the directional seated valve 324 to generate the required pressure. The directional seated valve 324 controls the oil from the second pumping element P2 302*b*. When the pressure reaches or exceeds the maximum pressure, the oil is passed to the tank via T hole 218 through the directional seated valve 324. Until the pressure reaches the maximum pressure, the four-way two positional directional valve 308 receives the oil from the second pumping element P2 302*b* through the check valve 322. The four-way two positional directional valve 308 further passes the oil to either the terminal A 310 or the terminal B 312, depending upon the stroke.

The third pumping element P3 302*c* works in association with the directional seated valve 326 to generate the required pressure. The directional seated valve 326 controls the oil from the third pumping element P3 302*c*. When the pressure reaches or exceeds the maximum pressure, the oil is passed to the tank via T hole 218 through the directional seated valve 326. Until the pressure reaches the maximum pressure, the four-way two positional directional valve 308 receives the oil from the third pumping element P3 302*c* through the check valve 320. The fourth pumping element P4 302*d* works at 0.3 LPM to generate up to 10,000 psi pressure. The first three check valves 318, 320, and 322 are used for preventing the flow of the oil, pumped using the forth pumping element P4 302*d*, back to the sealed oil tank 104 through the second pumping element P2 302*b* and the third pumping element P3 302*c*.

The terminal A 310 or the terminal B 312 receives the oil returned from the hydraulic torque wrench. The directional seated valve 314 is used to keep the pressure at or below the predetermined maximum. The pressure relief valve 316 is used as a neutral position for the return stroke function. Once the return stroke is completed, the returned oil is passed to the directional seated valve 314. This causes heat generation in the hydraulic pump 100. If the pressure of the returned oil is above the predetermined pressure, the returned oil is passed to the sealed oil tank 104 through the directional seated valve 314. The returned oil is passed to the four-way two positional directional valve 308 if the pressure of the returned oil is equal to the predetermined pressure. The four-way two positional directional valve 308 passes the returned oil to the tank via T hole 218 through the one directional valve 318.

Returned oil will be directed to T hole 218 by way of directional valve 314 and/or 316 during the retract function. The breather 322 is used for keeping ambient air and other contaminates out of the hydraulic pump as well as to slightly pressurize the tank 104 so that the Pumping Elements (202*a*, 202*b*, 202*c*, 202*d*)(302*a*, 302*b*, 302*c*, 302*d*) are supercharged. Supercharged means that the oil is being pushed into the pumping elements rather than being sucked in. This process involving the returned oil allows the pumping elements to be efficient.

Figure 3B:
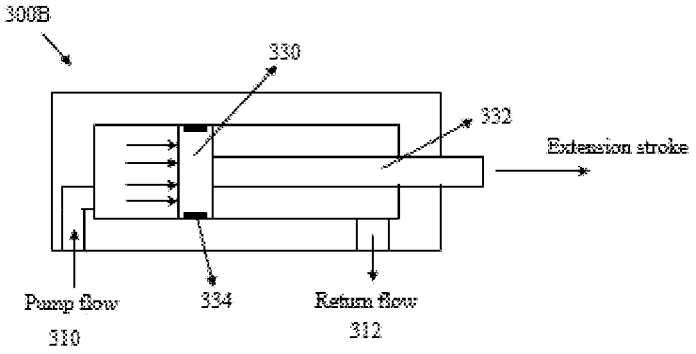
FIGS. 3B-3C show a schematic for the double acting cylinder connected to the hydraulic pump of FIG. 1A affixed with the electric manifold of FIG. 3A.

FIG. 3B shows a schematic 300B for a double acting cylinder in an extension stroke, in accordance with the embodiment illustrated by FIG. 3A. The double acting cylinder includes a piston 330, a rod 332, and a piston seal 334. In the extension stroke, the oil passes to the double acting cylinder by way of the terminal A 310 and piston 330 shifts to extend rod 224 in the double acting cylinder outward (i.e., to the right in FIG. 3B). The oil is returned to the hydraulic pump 100 by way of the terminal B 312 from the double acting cylinder. The piston seal 334 is used for preventing leakage in the double acting cylinder.

Figure 3C:
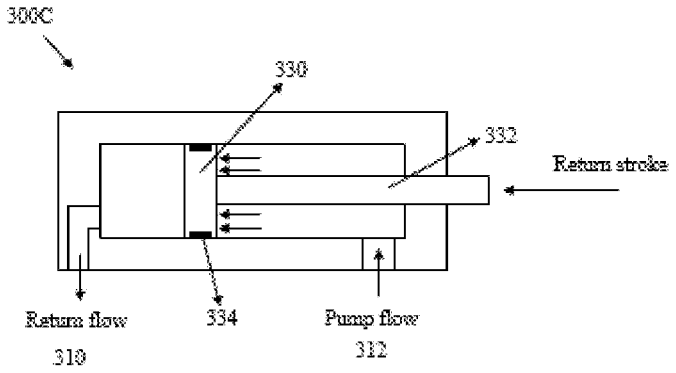

FIG. 3C shows a schematic 300C for the double acting cylinder in a return stroke, in accordance with an embodiment of the present invention. In the return stroke, the oil passes to the double acting cylinder by way of the terminal B 312 and piston 330 shifts to retract rod 224 into the double acting cylinder (i.e., to the left in FIG. 3C). The oil is returned to the hydraulic pump 100 by way of the terminal A 310 from the double acting cylinder.

Figure 4:
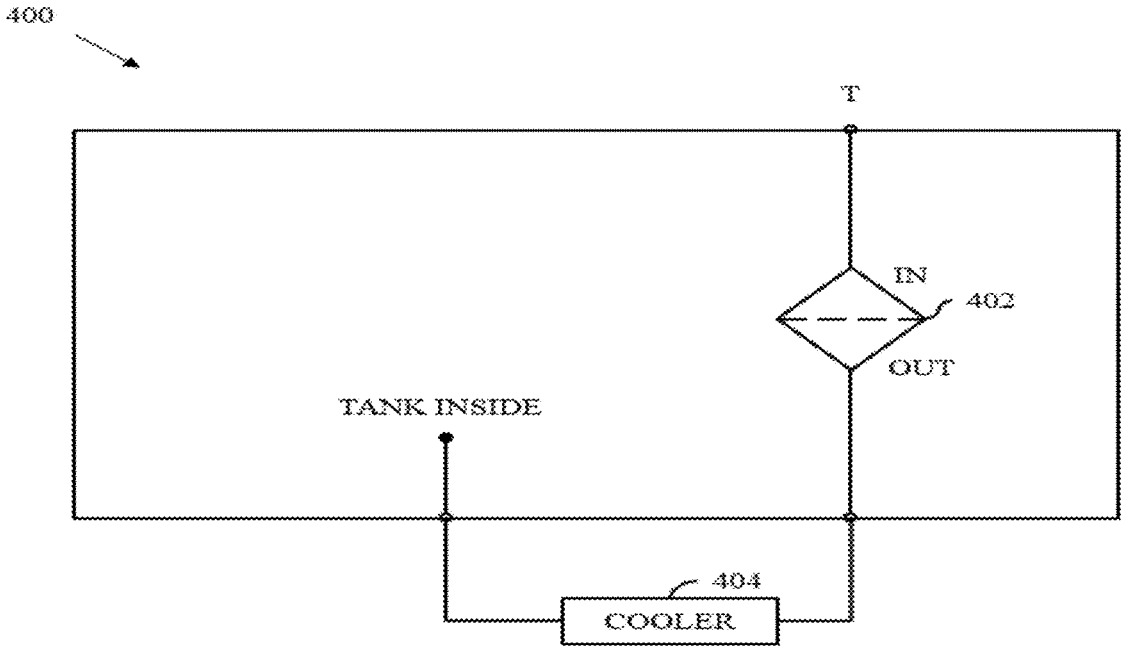
FIG. 4 shows a filtration and cooling system for the hydraulic pump of FIG. 1A.

FIG. 4 shows hydraulic schematic 400 of a filtration system 402 and cooling system 404, in accordance with the present invention. The filtration system 402 receives the returned oil by way of the T hole 218. The filtration system 402 filters out the impurities present in the returned oil from the T hole 218 with the help of a filtration screen which removes particles larger than between about 5 μm-10 μm. Temperature of the filtered oil is regulated with the help of the cooling system 404. The filtered, cooled oil is returned to the tank 104. In an embodiment, the cooling system 404 is an air-cooled heat exchanger that cools the returned oil. The cooling system 404 can be designed based on type of manifold. In one exemplary scenario, when the hydraulic pump 100 is fitted with the pneumatic manifold 102, exhaust air of the pneumatic motor is directed over a heat exchanger to regulate temperature of the returned oil. In another exemplary scenario, when the hydraulic pump 100 is fitted with the electric manifold 300, an electric fan is used to force ambient air over a heat exchanger to regulate temperature of the returned oil. The filtration system 402 filters the returned oil to remove particles greater than about 5 μm and passes it to the cooling system 404. The cooling system 404 regulates the temperature of the returned oil at a desired level depending on the grade and quality of the oil. In one exemplary scenario, to regulate quality of the returned oil of grade 32, the cooling system 404 maintains the temperature of the returned oil below a maximum of 40° C.

The electric motor used in the hydraulic pump 100 is a high-efficiency electric motor that has high power-to-weight ratio and yields efficiencies in a range of 90% to 95%. The conventional electric motors used in conventional hydraulic pumps have efficiencies in the range of 65% to 70% with high start-up current (Amp) draws. Exemplary motors include, but are not limited to, brushless DC motors or AC motors.

The valves used in the electric manifold 300A are operated in such a way that the valves stay within the electric motor power limits while creating faster flow of the oil in the hydraulic pump 100. It has been found that conventional hydraulic pumps utilize valves in an inefficient manner, which ultimately leads to inefficient use of the electric motor. Generally conventional hydraulic pumps have inefficient hydraulic circuits, which in turn leads to inefficient use of the valves and ultimately generates heat in the conventional hydraulic pumps. The present invention electric manifold 300A automatically adjusts the valves to create faster flow of the oil by remaining within the limits of the electric motor. When the conventional hydraulic pumps operate for prolonged periods, they tend to generate high load on the electric motor. The inventive electric manifold 300A automatically adjusts the valves in such a way that the load on the electric motor and the hydraulic pump 100 is as low as possible.

The automatic adjustment reduces excess heat generation and improves performance of the hydraulic pump 100. In one embodiment, the valves are controlled with the help of a control board. The control board is further programmed based upon the electric motor load via the pressure transducer 328.

Figure 5:
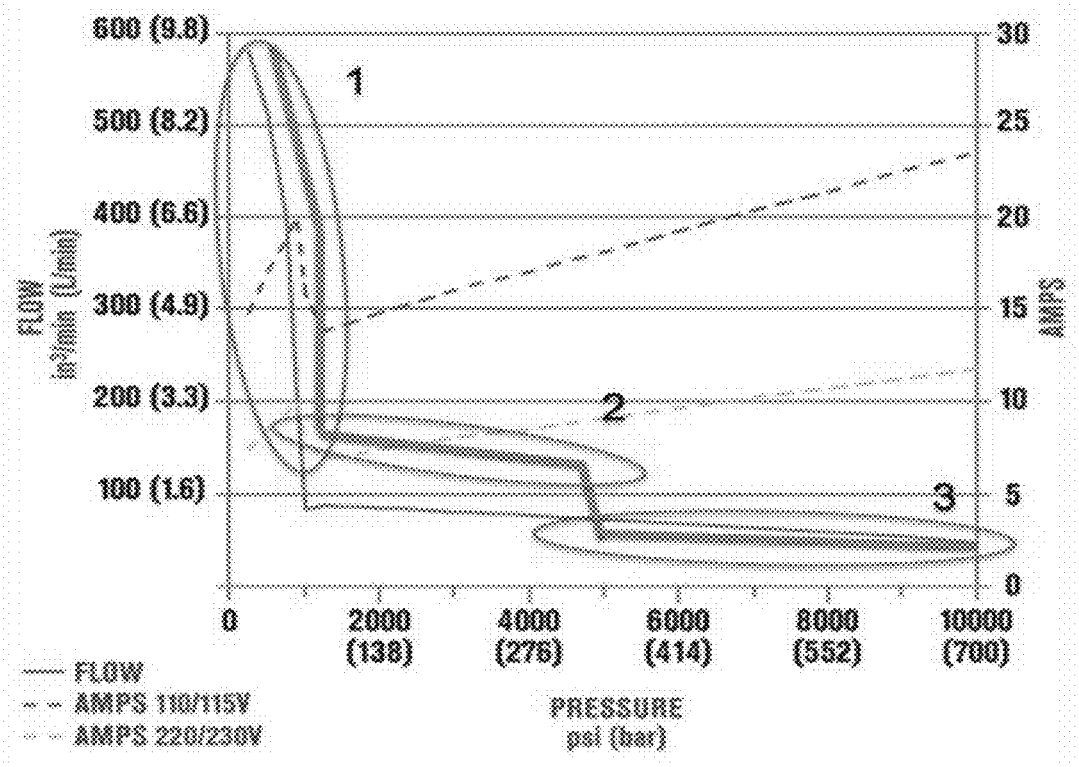
FIG. 5 shows a performance graph of a three-stage hydraulic pump.

FIG. 5 shows a performance graph of a three-stage pump. The hydraulic pump 100 used in the invention in some embodiments is of the three-stage type. X-axis of the performance graph represents pressure of the oil in psi and Y-axis represents flow of the oil in $in^3$/min. As shown in the performance graph, in the first stage 1, a small pressure increase is associated with a drastic decrease in the flowrate from 575 $in^3$/min to 175 $in^3$/min. In the second stage 2, the flowrate generally plateaus, such that a pressure increase from 1,000 psi to 4,500 psi is associated with a small decrease in the flow. In the third stage 3, the flowrate generally plateaus at a lower rate, such that a pressure increase of 5,000 psi to 10,000 psi pressure is associated with a similarly small decrease in the flow. The graph of the three-stage pump further represents balance between durability and speed of the hydraulic pump 100. Stage 1 (high flow-low pressure) has 1 pumping element. Stage 2 (medium flow and pressure) has 1 pumping element. The final stage (high pressure-low flow) has 2 pumping elements.

Figure 6:
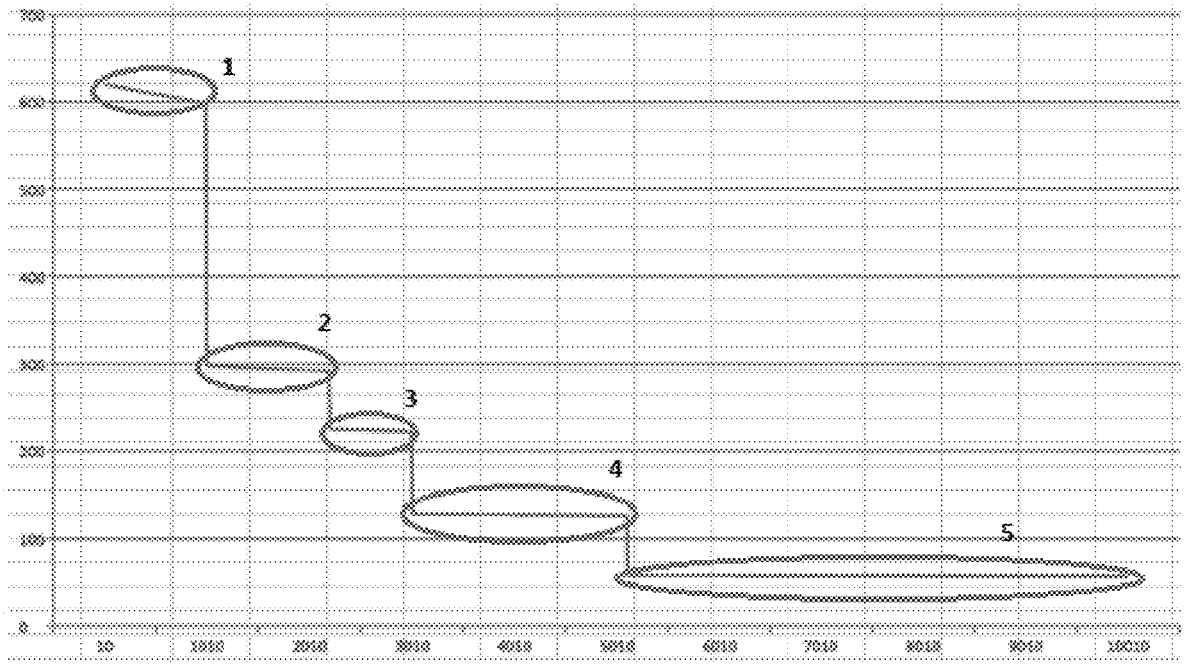
FIG. 6 shows a performance graph of a five-stage hydraulic pump.

FIG. 6 shows a performance graph of a five-stage pump. The hydraulic pump 100 used in an alternative embodiment of the invention is of the five-stage type. X-axis of the performance graph represents pressure of the oil in psi and Y-axis represents flow of the oil in $in^3$/min. As shown in the performance graph, none of the stages exhibit the drastic drop in flowrate exhibited in the first stage of a three stage pump. Each stage experiences generally a plateau in flowrate. In the first stage 1, the pump generates a pressure increase from 10 psi to 1,000 psi for a small decrease in flow. In the second stage 2, the pump generates a pressure increase from 1,010 psi to 2,200 psi for a small decrease in the flow. In the third stage 3, the pump generates a pressure increase from 2,210 psi to 3,000 psi for a comparable decrease in flow. In the fourth stage 4, the pump generates a pressure increase from 3,010 psi to 5,100 psi for a small decrease in the flow. In the fifth stage 5, the pump generates a pressure increase from 5,110 psi to 10,010 psi for a small decrease in the flow. In FIGS. 5 and 6, the graphs illustrate the speed at which hydraulic wrench tools operate with the hydraulic pump 100. Each subsequent stage exhibits reduced flow as pressure increases to stay within the limits of the electric motor's horsepower/torque capacity, based upon the load required to overcome the frictional forces of a nut. At low pressures, higher flow produces a faster stroke, which occurs when the friction forces between the nut and its mating surface are low. As more force/torque is necessary to turn the nut, the pressure increases and flowrate decreases producing a slower stroke.

The present invention also provides a novel method to cool and filter substantially all oil in the system by way of the hydraulic circuit illustrated in FIGS. 2A and 3A.

The inventive method cools the oil by running it through a radiator or oil cooler prior to returning the oil to the tank. The radiator or oil cooler is cooled using cold air from the air motor exhaust. The inventive method cools oil at least as effectively as a prior art cooling method without creating a condensation point.

The embodiments of the present invention offer the following advantages. The filtration system 402 and cooling system 404 filter impurities from the returned oil and regulate the temperature of the filtered oil. The filtration and cooling systems 402 and 404 thus aid in improving performance and life of the oil. The filtration and cooling systems 402 and 404 further aid in improving the life of the O-ring and the honed components of the pump. Thus, the present invention ensures improved performance and life of the hydraulic pump. The improved life of the oil helps in reducing oil consumption and oil disposal fees. Moreover, the present invention reduces operational costs. The sealed oil tank 104 aids in preventing impurities from contaminating the oil. This helps in keeping the oil clean. The filtration and cooling systems 402 and 404 filter and cool all oil pumped by the pumping elements of the hydraulic pump 100. In the present invention, the returned oil passes through the filtration and cooling systems 402 and 404 before it enters the sealed oil tank. This helps the hydraulic pump 100 to keep the sealed oil tank clean even after oil passes through dirty hoses and fittings.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claim.

The present invention has been described herein with reference to a particular embodiment for a particular application. Although selected embodiments have been illustrated and described in detail, it may be understood that various substitutions and alterations are possible. Those having an ordinary skill in the art and access to the present teachings may recognize additional various substitutions and alterations are also possible without departing from the spirit and scope of the present invention.

What is claimed is:

1. A hydraulic pump comprising:

a motor and one or more pumping elements arranged within a protective frame;

at least one sealed oil tank arranged in the protective frame, wherein the sealed oil tank communicates with a first passage for receiving recovered oil and a second passage for communicating with a suction port of the hydraulic pump;

a twin-line hose adapted to circulate oil between the sealed oil tank and a hydraulic torque wrench; and a filtration system and a heat exchange system arranged in a tandem fashion and accommodated within the first passage;

wherein the first passage is configured such that the filtration system receives substantially all oil recovered from the hydraulic torque wrench via the twin-line hose and substantially all oil drawn from the suction port of the hydraulic pump that bypasses the hydraulic torque wrench; and wherein the first passage is further configured such that the heat exchange system receives all oil from the filtration system, maintains the filtered oil temperature at a predetermined value and delivers all oil exiting the heat exchange system to the sealed oil tank.

2. The hydraulic pump of claim 1, wherein the heat exchange system includes an air-cooled heat exchanger.

3. The hydraulic pump of claim 1, wherein the motor is at least one of an electric motor or a pneumatic motor.

4. The hydraulic pump of claim 1 further comprising at least one manifold selected from the group consisting of a pneumatic manifold and an electric manifold, said manifold adapted and configured to circulate oil between the suction port and the hydraulic torque wrench by way of the twin line hose.

5. The hydraulic pump of claim 4, further comprising one or more valves for controlling pressure in the hydraulic pump.

6. The hydraulic pump of claim 1, wherein the filtration system removes particles greater than 10 μm from the recovered oil.

7. The hydraulic pump of claim 1, wherein the heat exchange system maintains filtered oil at a temperature between about 0° C. and about 40° C.

* * * * *